United States Patent [19]

Graham

[11] 3,961,552

[45] June 8, 1976

[54] MEANS FOR CUTTING SQUARES

[76] Inventor: Walter B. Graham, 1010 S. 91st St., Omaha, Nebr. 68114

[22] Filed: May 30, 1975

[21] Appl. No.: 582,122

[52] U.S. Cl. ..... 83/821; 33/95; 83/745

[51] Int. Cl.[2] ..... B26D 7/00

[58] Field of Search ..... 83/745, 743, 821, 829; 33/95, 96, 112, 113, 114

[56] References Cited

UNITED STATES PATENTS

| | | | |
|---|---|---|---|
| 752,823 | 2/1904 | Cary | 33/95 |
| 1,220,664 | 3/1917 | Maxwell | 33/95 |
| 1,290,811 | 1/1919 | Ware | 33/96 |
| 2,720,706 | 10/1955 | Laine | 33/95 |
| 3,224,100 | 12/1965 | Rose | 33/95 |
| 3,878,615 | 4/1975 | Peterson | 33/95 |

*Primary Examiner*—Frank T. Yost

*Attorney, Agent, or Firm*—Zarley, McKee, Thomte & Voorhees

[57] ABSTRACT

A method and means for cutting or ruling squares is disclosed. The device comprises first and second flat guide members which are adapted to be positioned on the film halftone or diffusion transfer print. The first flat guide member comprises an elongated base portion and an elongated leg portion extending from one end of the base portion at a right angle thereto. The base and leg portions have inner guide edges formed thereon. The second flat guide member comprises an elongated base portion and an elongated leg portion extending from one end of the base portion at a right angle thereto. The base and leg portions of the second guide member have outer guide edges complementary to the inner guide edges of the first guide member. The base and leg portions of the second guide member also have inner guide edges provided thereon. The two guide members are used together to either rule or cut four perfect 90° rules or cuts on four sides of the film halftone or diffusion transfer print.

1 Claim, 5 Drawing Figures

MEANS FOR CUTTING SQUARES

BACKGROUND OF THE INVENTION

It is frequently necessary to either rule or cut four perfect 90° cuts on four sides of a film halftone or diffusion transfer print. The presently available devices for ruling or cutting halftones or prints are not as fast or accurate as is desirable.

Therefore, it is a principal object of the invention to provide a method and means for cutting or ruling squares.

A further object of the invention is to provide a fast accurate method of ruling or cutting four perfect 90° cuts on four sides of a film halftone or diffusion transfer print.

A still further object of the invention is to provide a device for cutting or ruling squares which may be used to measure height and width if crop marks are not present on the film halftone or diffusion transfer print.

A further object of the invention is to provide a device for ruling or cutting squares which is durable in use, refined in appearance and economical in manufacture.

These and other objects will be apparent to those skilled in the art.

BRIEF DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings, in which:

DESCRIPTION OF THE PREFERRED EMBODIMENT AND METHOD

Figure 1:
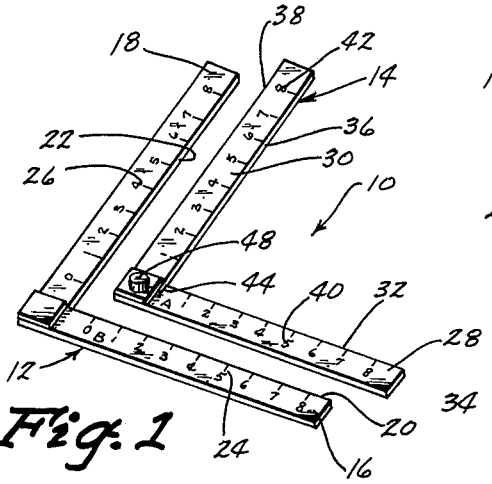
FIG. 1 is a perspective view of the device of this invention.

The device of this invention is referred to generally by the reference numeral 10 and comprises a first flat guide member 12 and a second flat guide member 14. Guide member 12 comprises an elongated base portion 16 having an elongated leg portion 18 extending from one end thereof at a right angle thereto. Base portion 16 is provided with an inner guide edge 20 and leg portion 18 is provided with an inner guide edge 22 as illustrated in the drawings. Base portion 16 is provided with a scale 24 having the 0 index spaced a predetermined distance from guide edge 22. Leg portion 18 is provided with a scale 26 positioned along the inner edge thereof and having the 0 index spaced a predetermined distance above edge 20.

Figure 3:
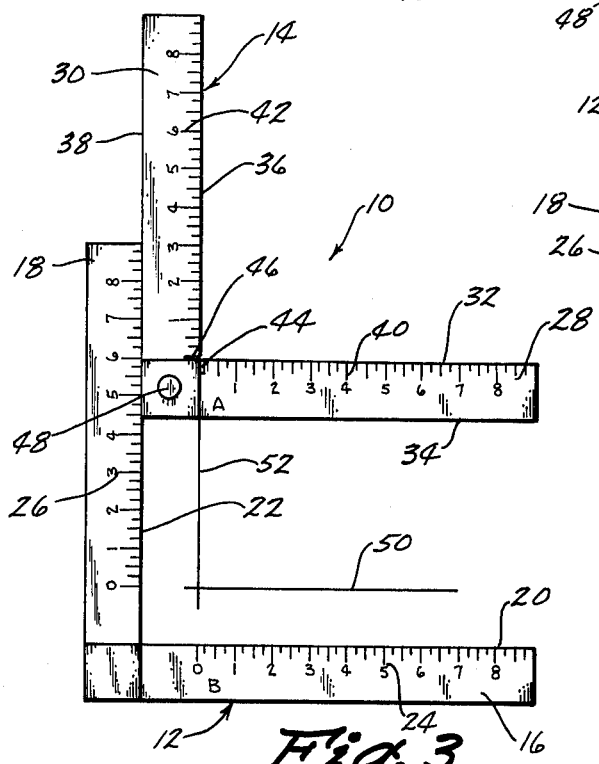
FIGS. 3, 4 and 5 are top views similar to FIG. 2 but which illustrate the sequence in ruling or cutting four perfect 90° rules or cuts on four sides of a film halftone or diffusion transfer print.

Guide member 14 comprises an elongated base portion 28 having an elongated leg portion 30 extending from one end thereof at a right angle thereto. Base portion 28 is provided with an inner guide edge 32 and an outer guide edge 34. Leg portion 30 is provided with an inner guide edge 36 and an outer guide edge 38. Base portion 28 is provided with a scale 40 positioned along its inner guide edge while leg portion 30 is provided with a scale 42 positioned along its inner guide edge. A notch 44 extends downwardly into edge 32 adjacent edge 36 as seen in FIG. 3. As also seen in FIG. 3, a notch 46 extends inwardly into edge 36 adjacent edge 32. Scale 40 has its 0 index in alignment with edge 36 and scale 42 has its 0 index in alignment with edge 32. For purposes of convenience, the knob 48 is secured to guide member 14.

Figure 2:
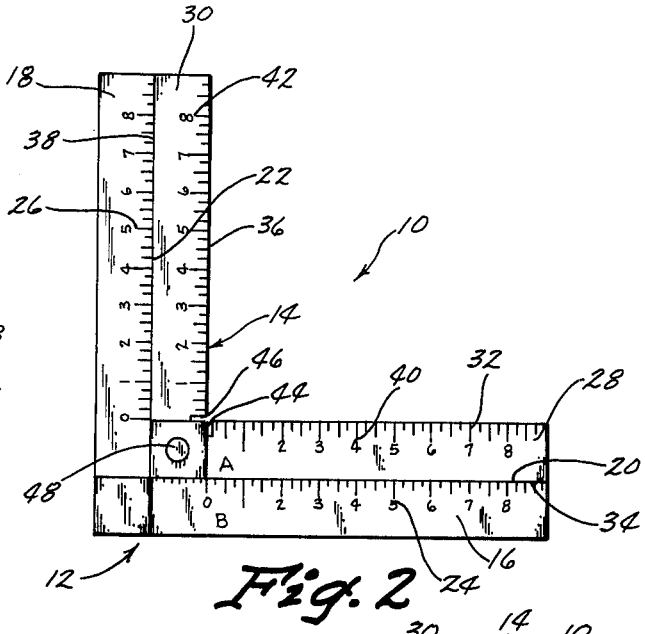
FIG. 2 is a top view of the device.

As seen in FIG. 2, the 0 index of scale 24 is spaced laterally from edge 22 a distance which corresponds to the width of leg portion 30 of member 14. As also seen in FIG. 2, the 0 index of scale 26 is spaced above edge 20 a distance corresponding to the width of base portion 28.

Figure 4:
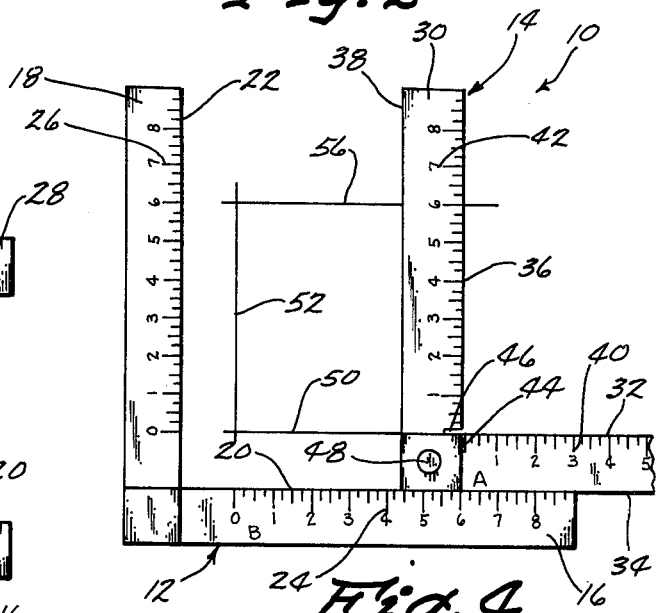
Figure 5:
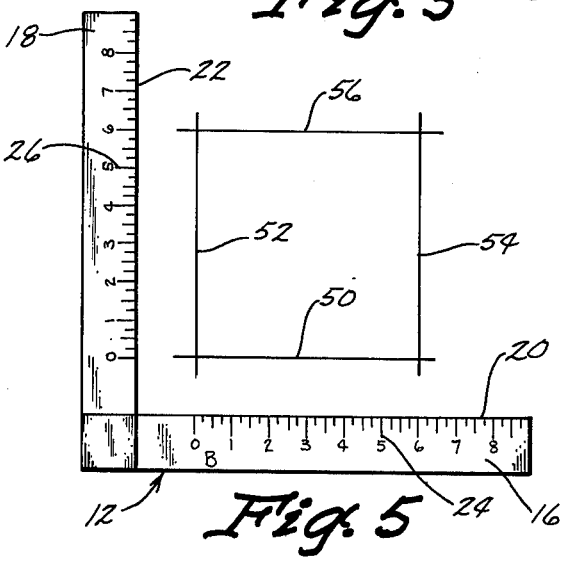

The following method or instructions refer to cutting a screened paper print but it should be understood that the same procedure would apply to using the device for negatives or ruling 90° parallelograms on pasteups. Guide member 14 is initially placed on the diffusion transfer print so that guide edges 32 and 36 are aligned with the bottom crop mark and the left crop mark on the print. A knife point is then placed in notch 46 and the knife is drawn along edge 32 to make the bottom cut generally referred to by the reference numeral 50. The knife point is then placed into the slot or notch 44 with the knife then being drawn along the edge 36 to form the vertical cut 52. Without disturbing guide member 14, guide member 12 is placed against the outside guide edges 34 and 38 of guide member 14 as illustrated in FIG. 2. Guide member 14 may then be moved to the right as illustrated in FIG. 4 and positioned at the desired width of the picture. A vertical cut 54 is then formed in the same manner as the vertical cut 52 to achieve the trim at the right side of the print. Without disturbing guide member 12, guide member 14 is then placed at the top trim point as illustrated in FIG. 3 with the horizontal cut 56 being formed as was the cut 50. If desired, the cut 56 could be formed prior to the cut 54 as is illustrated in the drawings.

While it has been described that cuts are formed in the diffusion transfer print, it should be understood that the print could also be ruled with a pencil or the like if desired. The scales 24 and 26 may be used to measure the height and width of the print or may be ignored if the crop marks are provided on the print. The spacing of the 0 indices on scales 24 and 26 compensates for the widths of the base and leg portions 28 and 30 respectively. The spacing permits the guide member 14 to be moved to the right relative to guide member 12 until the 0 index of scale 40 is in alignment with the desired width. For example, FIG. 4 illustrates that a cut is being made wherein the print has a width of 6 inches. The same is also true in creating the desired height of the print.

Thus it can be seen that a unique device for cutting or ruling squares has been provided which permits a fast and accurate method of ruling or cutting for perfect 90° cuts on four sides of a film halftone or diffusion transfer print. It can also be seen that the device and method accomplish at least all of the stated objectives.

I claim:

1. A device for cutting squares, comprising, a first flat guide member comprising an elongated base portion and an elongated leg portion extending from one end of said base portion at a right angle thereto, said base and leg portions having inner guide edges formed thereon, and a second flat guide member comprising an elongated base portion and an elongated leg portion extending from one end of said base portion at a right angle thereto, said base and leg portions having outer guide edges complementary to the inner guide edges on said first guide member, said base and leg portions of said second guide member having inner guide edges provided thereon, said base and leg portions of each of said first and second guide members having scales provided thereon, said scales on said base and leg portions of said first guide member having their 0 indices spaced a predetermined distance from the inner guide edges of said leg and base portions respectively, said spacing corresponding to the width of said base and leg portions of said second guide member respectively.

* * * * *